US005198789A

United States Patent [19]

Taylor

[11] Patent Number: 5,198,789

[45] Date of Patent: Mar. 30, 1993

[54] LOGIC LEVEL ELECTRICAL INTERLOCK DEVICE

[75] Inventor: Glen D. Taylor, Fayetteville, N.C.

[73] Assignee: Westinghouse Electric Corp., Pittsburgh, Pa.

[21] Appl. No.: 735,600

[22] Filed: Jul. 25, 1991

[51] Int. Cl.[5] ..... H01H 67/02

[52] U.S. Cl. ..... 335/132; 335/205

[58] Field of Search ..... 335/6, 131-132, 335/202, 205-207, 151

[56] References Cited

U.S. PATENT DOCUMENTS

| | | | |
|---|---|---|---|
| 3,594,615 | 7/1971 | Cortelli | 335/236 |
| 3,753,179 | 8/1973 | Straub | 335/205 |
| 3,821,671 | 6/1974 | Grunert et al. | 335/132 |
| 3,961,309 | 6/1976 | Eddy | 200/61.22 |
| 4,309,683 | 1/1982 | Grunert et al. | 335/132 |
| 4,933,655 | 6/1990 | Matsubara | 335/205 |

*Primary Examiner*—Lincoln Donovan
*Attorney, Agent, or Firm*—M. J. Moran

[57] ABSTRACT

A logic level interlock device for an electrical contactor having an armature carrying separable contacts is provided. The interlock includes a plunger which is movable with the armature as the armature moves between its open and closed positions. A logic level sensing means is provided adjacent the plunger. An activation means which is sensed by the logic level sensing means is carried by the plunger member. In one embodiment of the invention, the sensing means is a set of magnetic reed switches which are activated by a permanent magnet carried on the plunger. In another embodiment of the invention, the sensing means is an opto-coupler circuit. The activation means carried on the plunger is perferably an opening which allows the infrared radiation to pass through to the receiver portion of the opto-coupler. In accordance with yet a further embodiment of the invention, the sensing means are two inductive sensing elements which are activated by a permanent magnet or a ferrite bead. In each case, a logic level signal is generated which is communicated to an associated microprocessor or other device.

16 Claims, 3 Drawing Sheets

LOGIC LEVEL ELECTRICAL INTERLOCK DEVICE

BACKGROUND OF THE INVENTION

1. Field of the Invention

This invention relates to a logic level interlock device for use with an electric control device such as a contactor or relay.

2. Background Information and Description of the Prior Art

Industrial equipment that is operated electrically such as by a motor is usually regulated by a control device which may be a contactor or a relay having parts movable between two positions for opening and closing a circuit through the motor. Some electric control devices utilize auxiliary contact assemblies for separate interlocking functions in numerous variations. Conventionally, these auxiliary contact devices have been actuated by an actuating member connected to the electromagnetic operating means responsible for opening and closing the electric circuit through the contactor.

Electromechanical interlock devices have been known such as that provided in U.S. Pat. No. 4,309,683 which is owned by the assignee of the present invention. U.S. Pat. No. 4,309,683 provides an electric control device having an auxiliary contact device which includes a contact carrying structure that controls the contacts of the control device. When the electric control device is energized, the insulating contact carrier is pulled down bringing a set of movable contacts into electrical contact with a set of stationary contacts. The main contact carrier also controls an auxiliary contact carrier. The main contact carrier, by means of a slot which engages a protruding tab on the auxiliary contact carrier moves the auxiliary contact carrier downward which closes the contacts of the auxiliary contact device. When the control device is deenergized, the contact carrier moves upward to its normal position and this motion also causes the slots to carry the auxiliary contact carrier to its normal position.

The conventional auxiliary interlock devices such as that described above operate at the same high current and high voltages as the other components in the conventional electric control system. More recently, however, it is preferred to use microprocessors or other programmable logic controllers ("PLCs") for control of the contactor and motor assembly. It is necessary, therefore, that the interlock device for sensing whether the contactor is opened or closed generate a logic level signal of 5 volts or less. Such low voltage signals are not amenable to use with the conventional auxiliary contacts such as that described above. The low voltages can cause the contacts to oxidize. This can in turn result in unnecessary contact wear.

There remains a need for a device which can generate a logic level signal in response to the contactor or motor controller which will avoid the above mentioned problems of oxidation of contacts and early contact wear. In addition, there remains a need for a device which can operate with low level strobed circuits for position sensing such as on/off sensing in controlled feedback networks. There remains yet a further need for an interlock for use with contactors which provides signals for communication with microprocessors and other similar devices.

SUMMARY OF THE INVENTION

These and other needs have been satisfied by the device of the present invention which provides an interlock which operates at logic level voltages and which can be utilized with existing contactors for controlling motors. The interlock includes a plunger assembly which interacts with the existing armature on the contactor. The plunger is movable by the armature when the armature moves between its opened and closed positions. Thus, the interlock device gains its information about the location of the armature and the on/off state of the contactor through its own separate plunger member. A logic level sensing element is mounted adjacent to the plunger. The logic level sensing means senses motion or change in position of the plunger. An activation element carried by the plunger selectively activates the logic level sensing means as appropriate in the circumstances. In some instances, information about whether the contacts of the contactor are opened or closed can be provided and in other instances the invention provides information as to motion of the armature of the contactor. The plunger member may be provided with a biasing member or kickout spring which returns the plunger to its original position after the armature returns to its original position out of engagement with the plunger. Several embodiments of the invention are provided.

Advantages of this device are that it may be utilized with existing contactors and it generates logic level signals which are capable of communicating with associated microprocessors and which will not result in unnecessary oxidation or wear of contacts.

DESCRIPTION OF THE PREFERRED EMBODIMENTS

Figure 1:
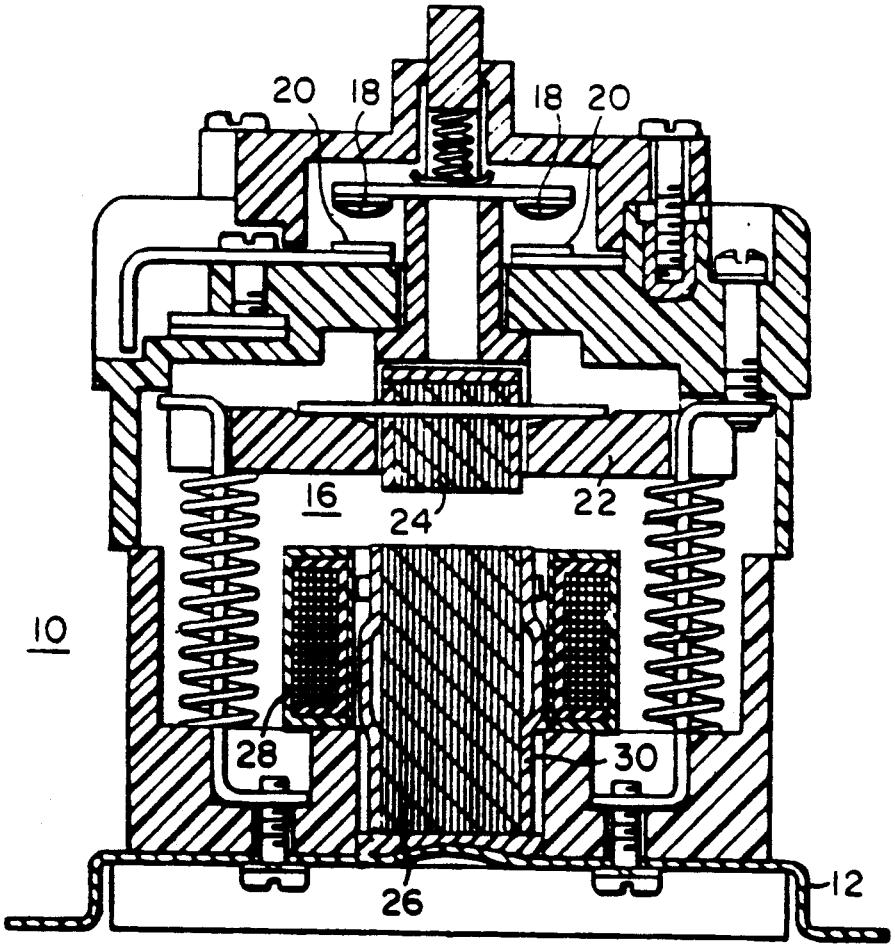
FIG. 1 PRIOR ART
FIG. 1 is a cross section of a contactor in accordance with the prior art.

An electric contactor is indicated generally at 10 in FIG. 1. The contactor is more specifically described in U.S. Pat. No. 3,821,671 owned by the assignee of the present invention. The disclosure of that patent is incorporated herein by reference.

Briefly, the contactor 10 comprises a baseplate 12 and an operating structure generally indicated at 16. The contactor 10 is a multi-pole control device of which only one set of poles is shown in FIG. 1. Contactor 10 includes movable contacts 18 and stationary contacts 20. The contactor 10 is operated by an electromagnetic actuator which includes a molded insulating contact carrier 22 and a generally U-shaped magnetic armature 24.

The electromagnetic actuator also includes a generally U-shaped magnetic core 26 and a coil structure 28. When the coil 28 is energized, magnetic core 26 attracts armature 24 towards it, thus pulling movable contacts 18 to meet contacts 20.

The device of the present invention operates with armature 24 such that when armature 24 moves to its downward position (which may in some other types of contactors be a different direction), the logic level interlock of the present invention is similarly actuated.

Figure 2:
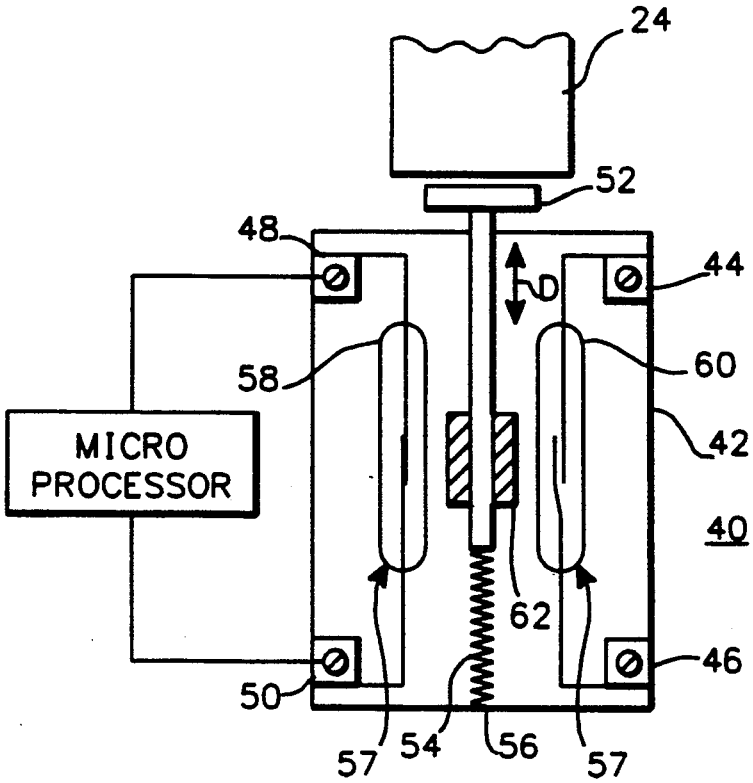
FIG. 2 is a side section of an interlock device in accordance with one embodiment of the present invention including magnetic reed switches.

More specifically, with reference to FIG. 2, one embodiment of the present invention is shown. The device is generally indicated at 40 and it is contained within housing 42. Housing 42 has terminal saddles 44 and 46 on one side and terminal saddles 48 and 50 on the opposite side. Housing 42 also includes a plunger 52 which is movable back and forth in the direction indicated by arrow D. Plunger 52 is capable of being engaged by armature 24. For example, when armature 24 moves downwardly in FIG. 2, plunger 52 would similarly move downwardly. In the device of FIG. 1, downward motion of armature 24 results in contacts 18 mating with contacts 20, and thus the device is in the "ON" state. When the armature 24 returns to its initial position which is an upward motion as seen in FIG. 2, plunger 52 would not otherwise move except that it is provided with kickout spring 54. Kickout spring 54 is preferably a compression spring which is provided at the base 56 of plunger 52 to provide the force necessary to return plunger 52 to its initial position after armature 24 moves out of contact with the plunger 52. Plunger 52 could be mechanically interlocked with the armature 24 so that the spring 54 would not be required. However, the arrangement shown in FIG. 2, which includes the spring 54, is preferred so that the interlock does not load the kickout spring of the contactor itself.

In order to sense motion of the plunger and in turn motion of armature 24, the sensing device 57 of the embodiment of FIG. 2 is provided. The sensing device 57 includes at least one vacuum sealed magnetic reed contact switch. Alternatively, any combination of normally open or normally closed contact switches can be provided within the scope of this aspect of the invention. This depends upon the application with which the device is used. Two switches may be preferable if it is desirable to communicate with two different PLCs for example. If, on the other hand, a single output is all that is necessary, then a single switch may be used. For purposes of this disclosure, one normally open and one normally closed switches are incorporated in the sensing device 57, however, it should be understood that variations may be made on this design while remaining within the scope of this invention.

A normally open magnetic reed contact 58 is provided adjacent one side of plunger 52. A second contact switch which may be a normally closed magnetic reed contact switch 60 is provided on the opposite side of plunger 52. A permanent magnet 62 is provided on plunger 52 and is carried with plunger 52 as it moves in response to the motion of armature 24. The permanent magnet 62, when moved, passes adjacent to contact switches 58 and 60 and actuates the switches. This can occur when the plunger, for example, is depressed by armature 24. Switch 58 is connected to terminals 48 and 50 which can ultimately be connected to external components such as a microprocessor 64 or other computer control device. Similarly, switch 60 is connected to terminals 44 and 46 which also lead to external components (not shown) which control the contactor. The switches 58 and 60 provide a logic level electrical signal indicative of the on/off state of the contactor 10.

As noted above, when armature 24 moves downwardly, as viewed in FIGS. 1 and 2, movable contacts 18 come into contact and engage stationary contacts 20 to operate the contactor 10. When this happens, armature 24 in turn depresses plunger 52 of device 40. This causes permanent magnet 62 to actuate switches 58 and 60 which then generate signals of a logic level voltage which may be then utilized by an associated microprocessor 64 or other logic level device (not shown).

Figure 3:
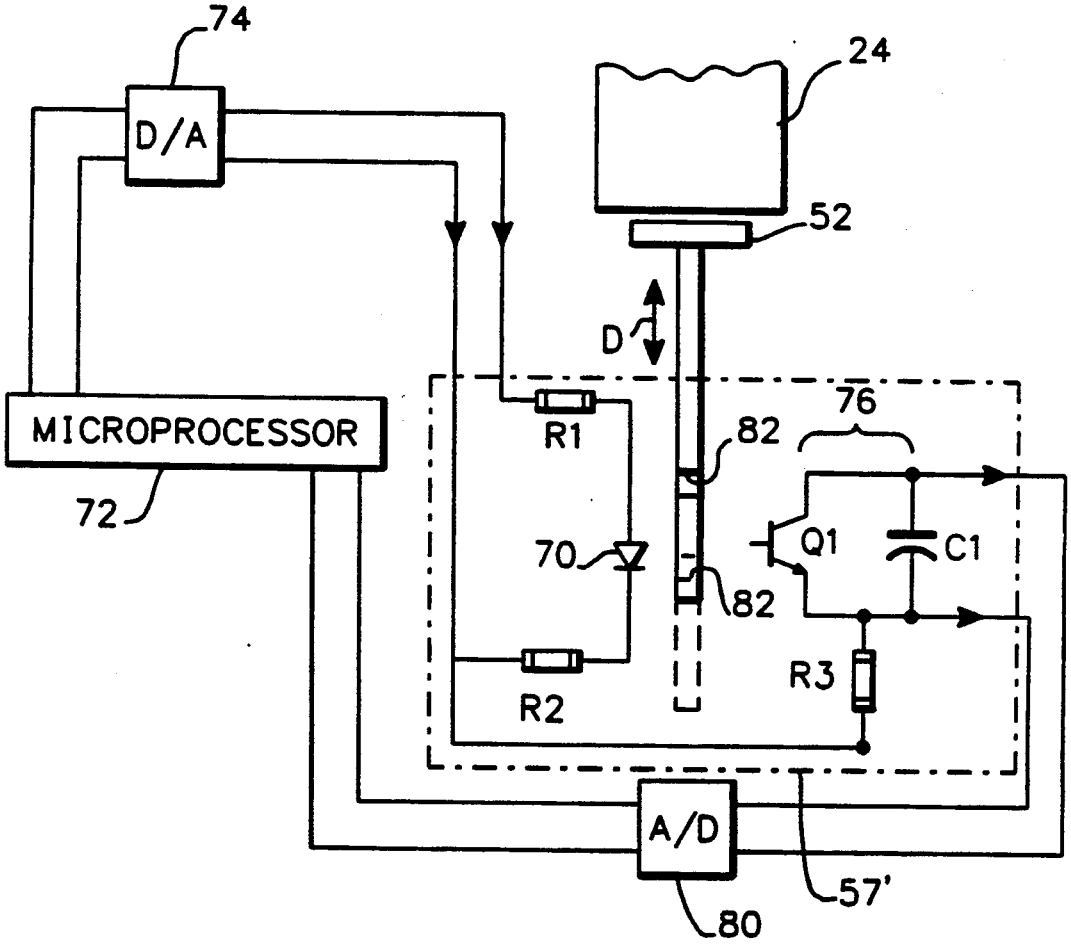
FIG. 3 is a schematic illustration of another embodiment of the interlock of the present invention showing an infrared radiation component.

Referring to FIG. 3, in accordance with another aspect of the invention, an opto-coupled circuit 57 including an infrared trigger or other radiation-generating component is used. For example, infrared light emitting diode (LED) 70 is shown. LED 70 is activated by way of microprocessor 72 through leads to resistors R1 and R2. The microprocessor 72 signals the device appropriately through D to A converter 74 or other suitable signal processing device as would be well understood by those skilled in the art. On the opposite side of plunger 52, an opto-coupled receiver is provided. The opto-coupled receiver is generally designated as 76. As would be understood by those skilled in the art, opto-coupled receiver 76 includes radiation sensitive transistor Q1 and capacitor C1. When radiation is sensed by transistor Q1, a signal is generated which ultimately is received by microprocessor 72 through A to D converter 80. Capacitor C1 protects transistor Q1 from high frequency noise. R3 is a current limiting resistor. Q1 is shown as a photo-transistor, however a photodiode or other suitable component may be used if desired in the application.

In order to regulate the radiation being sensed by transistor Q1, an opening 82 is provided in plunger 52. As opening 82 proceeds past LED 70 as is shown in phantom in FIG. 3, radiation passes through opening 82 towards transistor Q1, thus generating the signal as discussed above. On the other hand, with contacts 18, 20 open, the plunger 52 is moved so that opening 82 is not in the line of sight between LED 70 and Q1 so that radiation from LED 70 is blocked from reaching Q1 and turning Q1 on. This provides microprocessor 72 with the information about the position of the plunger, and ultimately, the position of the armature, namely, whether the armature is in the on or off state.

It should be understood that any variety of opto-coupler devices may be used to provide a wide variety of low level logic control signals as desired in the application. Control may be of local or remote source by the use of fixed screw-type external terminals or wire leads as shown in FIG. 3. A variety of contactor arrangements, voltage use requirements and logic level control can be obtained depending upon the components chosen. Advantages of this aspect of the invention include solid state reliability, logic level control, noiseless, bounceless control and flexibility due to the wide variety of infrared and opto-coupler designs available.

Figure 4:
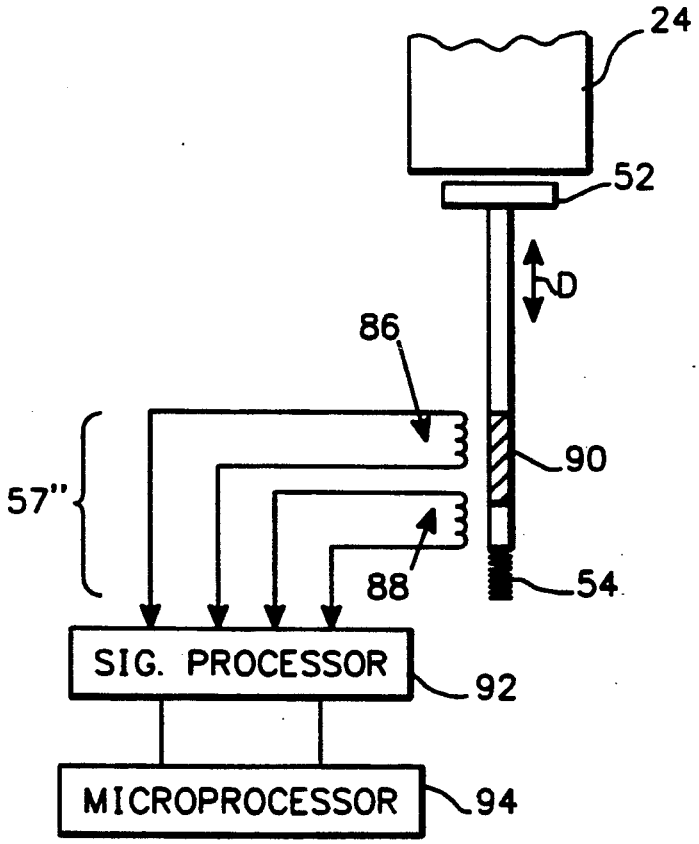
FIG. 4 is a schematic illustration of yet a further embodiment of the invention showing inductive sensors adjacent to the plunger.

Referring to FIG. 4, yet another embodiment of the present invention is shown. The device of FIG. 4 includes plunger 52 which is engaged by armature 24 in the manner discussed above. In accordance with the embodiment of FIG. 4, sensing device 57 includes at least one wound inductive sensing element adjacent to the plunger 52. Depending upon the application, it may be desirable to provide two inductive sensing elements. This would be true if, for example, two outputs are desired. One preferred embodiment may include two inductive sensors. As shown in FIG. 4, inductive sensing elements 86 and 88 are provided adjacent to plunger 52. The elements 86 and 88 are actuated by a magnetic device 90 which is carried on plunger 52. The magnetic device 90 may be a ferrite bead or permanent magnet. The first element 86 may be used for sensing a normally open ("OFF") state of the contactor and the second sensing element 88 may be used for sensing the normally closed or "ON" state. As stated above, the contactor armature 24 actuates plunger 52 by depressing the plunger 52. When depressed, plunger 52 moves the permanent magnet or ferrite bead 90 either through or near the inductive sensing elements 86 and 88 producing a small electrical signal that can be strobed or amplified by device 92 and used by microprocessor 94 to determine the on/off state of the contactor. Additionally, armature position can be sensed as well as contact wear and contact bounce from the signal generated by the sensing devices 86 and 88.

It should be understood that the present invention provides a logic level interlock device which is capable of handling low level strobing circuits for position sensing such as sensing the on/off condition of a motor contactor. This can be very useful in control feedback networks. The invention allows compatibility between conventional contactors and low level logic circuits for microprocessor control and feedback systems. The invention allows handling of low level logic circuits without oxidation of contacts, erratic behavior, noise or bounce problems as may be faced with the more conventional open type contacts used prior to the advent of the low level logic signals. The devices of the present invention could be implemented in a module which could be snapped into a cavity in the contactor of the type shown in U.S. Pat. No. 4,309,683.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical control device used with a motor energized by an electric power source, comprising:

an armature carrying a pair of separable contacts, said armature being movable between open and closed positions to open and close said separable contacts to selectively connect said motor to said electric power source;

a magnetic core having an associated coil means, said coil means when energized, causes said magnetic core to attract said armature to a closed position;

a plunger member movable with said armature between said open and closed positions;

logic level sensing means adjacent said plunger member; and activation means carried by said plunger member selectively activating said sensing means to generate a logic level signal representative of the position of said separable contacts, as said plunger member moves with said armature between said open and closed positions.

2. The electrical control device of claim 1 wherein said sensing means includes at least one magnetic reed switch, and said activation means includes a permanent magnet mounted on said plunger member and movable with said plunger member so that motion of said permanent magnet with said plunger member in response to motion of said armature activates said at least one magnetic reed switch, said switch generating a logic level signal in response to said activation.

3. The electrical control device of claim 1 wherein said sensing means includes opto-coupler means including radiation transmitter means and radiation receiver means located adjacent to said plunger member, and said activation means includes a radiation-transmissive component positioned on said plunger member to selectively pass radiation from said plunger member to said radiation receiver means upon motion of said plunger member in response to motion of said armature.

4. The electrical control device of claim 1 wherein said sensing means includes at least one inductive sensing element, and said activation means includes a magnetic element positioned on said plunger member and movable with said plunger member so that motion of said magnetic element on said plunger member in response to motion of said armature activates said at least one inductive sensing element, said sensing element generating a logic level signal in response to said activation.

5. The interlock of claim 2 wherein said magnetic reed switch has connecting means for transmitting said logic level signal to an associated external device in response to activation by said permanent magnet, said signal being indicative of the position of said armature.

6. The interlock of claim 5 wherein said sensing means includes two magnetic reed switches, a first switch being a normally-open switch mounted on one side of said plunger member and a second switch being a normally-closed switch mounted on an opposite side of said plunger member, so that when said plunger member carrying said permanent magnet moves in response to motion of said armature, said normally-open switch and said normally-closed switch are actuated.

7. The interlock of claim 6 wherein said plunger member also has biasing means urging said plunger member towards said armature so that when said armature moves to an open position from a closed position, said plunger member follows said armature.

8. The interlock of claim 3 wherein said radiation transmitter means includes an infrared light emitting diode, and said radiation received means comprises solid state component located at an opposite side of said plunger member for generating an output signal representative of the position of said armature base on the position of said plunger member in response to being impinged with infrared radiation.

9. The interlock of claim 8 wherein said radiation-transmissive component comprises an opening in said plunger member for selectively passing radiation therethrough to said radiation receiver means.

10. The interlock of claim 8 wherein said plunger member also has biasing means urging said plunger member towards said armature so that when said armature moves to an open position from a closed position, said plunger member follows said armature.

11. The interlock of claim 9 wherein said radiation receiver means includes connecting means for transmitting said logic level signals to an associated external device in response to activation by said radiation—transmissive component, said signal being indicative of the position of said armature.

12. The interlock of claim 4 wherein said sensing means includes two inductive sensing elements, a first inductive sensing element mounted adjacent said plunger member such that the open state of said armature is sensed and a first electrical signal is generated, and a second inductive sensing element mounted adjacent said plunger member such that the closed state of said armature is sensed and a second electrical signal is generated.

13. The interlock of claim 4 further comprising means connected to said at least one sensing element for receiving said signal and for transmitting said electrical signal to an associated external component.

14. The interlock of claim 13 wherein said external component is a microprocessor means for determining a condition of said contactor.

15. The interlock of claim 13 wherein said magnet element comprises a ferrite bead.

16. The interlock of claim 13 wherein said plunger member also has biasing means urging said plunger member towards said armature so that when said armature moves to an open position from a closed position said plunger member follows said armature.

* * * * *